United States Patent [19]

Sagel

[11] Patent Number: 4,970,737

[45] Date of Patent: Nov. 20, 1990

[54] ADJUSTABLE HOSPITAL AND NURSING HOME BED

[75] Inventor: Heinrich Sagel, Brakel-Erkeln, Fed. Rep. of Germany

[73] Assignee: Vauth-Sagel GmbH & Co., Brakel-Erkeln, Fed. Rep. of Germany

[21] Appl. No.: 364,288

[22] Filed: Jun. 12, 1989

[30] Foreign Application Priority Data

Feb. 10, 1989 [DE] Fed. Rep. of Germany ..... 3903874

[51] Int. Cl.[5] ..... A61G 7/002

[52] U.S. Cl. ..... 5/67; 5/63; 5/201; 5/285

[58] Field of Search ..... 5/66, 67, 68, 69, 201, 5/285, 63, 64

[56] References Cited

U.S. PATENT DOCUMENTS

| | | | |
|---|---|---|---|
| 6,594 | 7/1849 | Linikin | 5/68 |
| 541,586 | 6/1895 | Bickle | 5/64 |
| 1,075,291 | 10/1913 | Kertesz | 5/201 |
| 1,658,780 | 2/1928 | Nixon | 5/69 |
| 2,357,242 | 8/1944 | Wahl | 5/66 |
| 2,779,951 | 2/1957 | Travis | 5/69 |
| 3,015,113 | 1/1962 | Wallen | 5/63 |
| 3,456,269 | 7/1969 | Goodman | 5/68 |
| 3,965,500 | 6/1976 | Stein | 5/66 |
| 4,097,940 | 7/1978 | Tekulve | 5/68 |
| 4,202,062 | 5/1980 | Marcyan | 5/285 |
| 4,667,354 | 5/1987 | Carey | 5/64 |
| 4,685,160 | 8/1987 | Rizzardo | 5/201 |
| 4,723,808 | 2/1988 | Hines | 5/63 |

FOREIGN PATENT DOCUMENTS

| | | | |
|---|---|---|---|
| 2031471 | 1/1972 | Fed. Rep. of Germany | 5/67 |
| 2052351 | 4/1972 | Fed. Rep. of Germany | 5/67 |
| 2913712 | 10/1980 | Fed. Rep. of Germany | 5/66 |

*Primary Examiner*—Alexander Grosz
*Assistant Examiner*—F. Saether
*Attorney, Agent, or Firm*—Browdy and Neimak

[57] ABSTRACT

The adjustable hospital and nursing home bed, has a three-part support frame for mattresses, the head, middle and foot part of which are pivotably connected to one another via pivot shafts and are supported in a suspension frame of a bed frame such that they are pivotable in height directly by means of a force provider, preferably a gas spring and indirectly via a lever linkage. The suspension frame is embodied such that it is divided transversely to the longitudinal direction of the bed and such that it can be taken apart, and is retained removably on head- and footboards of the bed frame. The headboard and footboard are embodied such that they telescope within one another and are continuously adjustable in height along with the suspension frame and the support frame, by means of gas springs.

3 Claims, 3 Drawing Sheets

Fig.2a
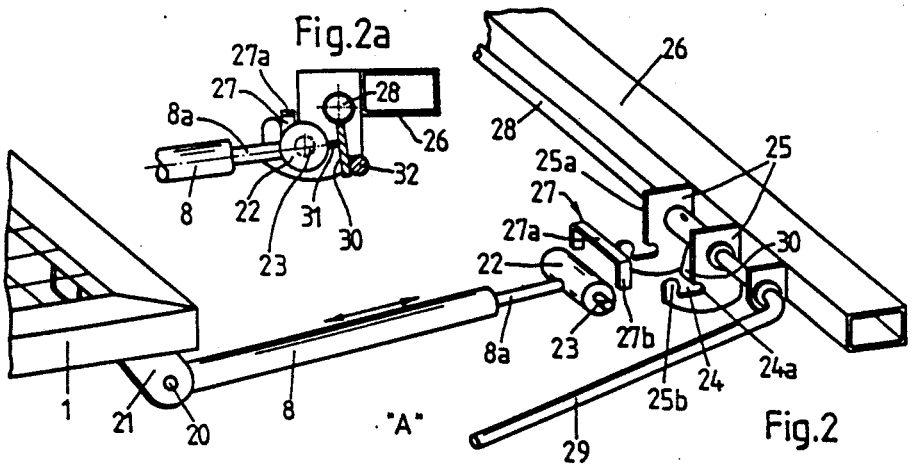
Fig.2
Fig.3a
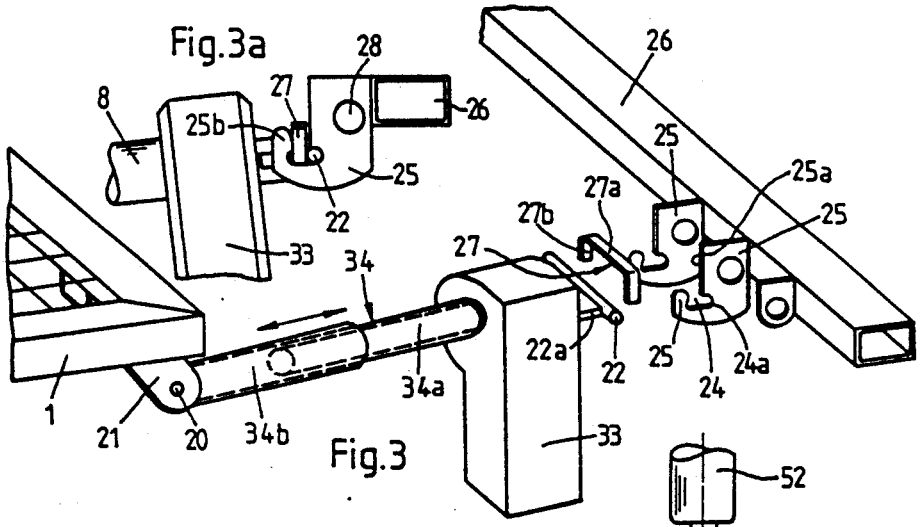
Fig.3
Fig.4
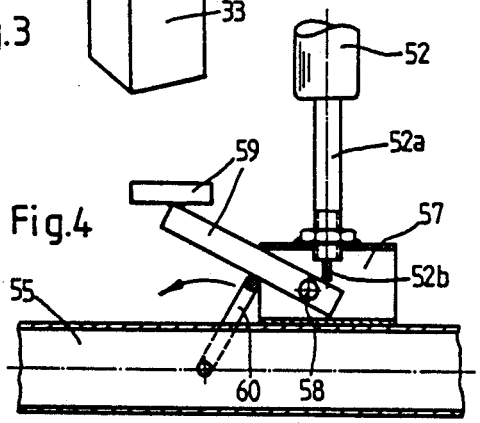

Fig.5
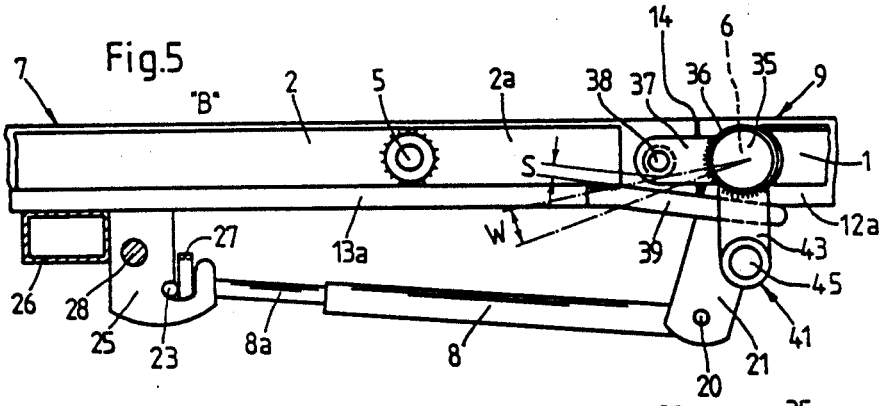
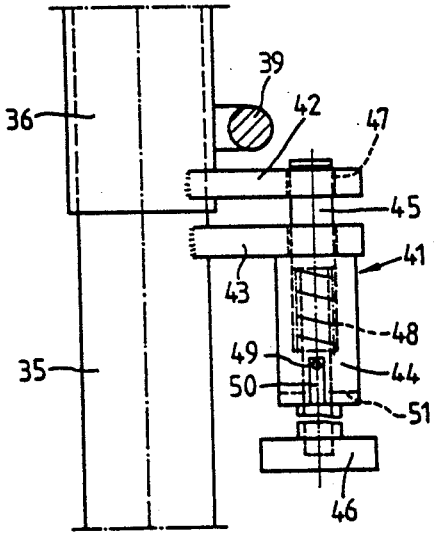
Fig.7
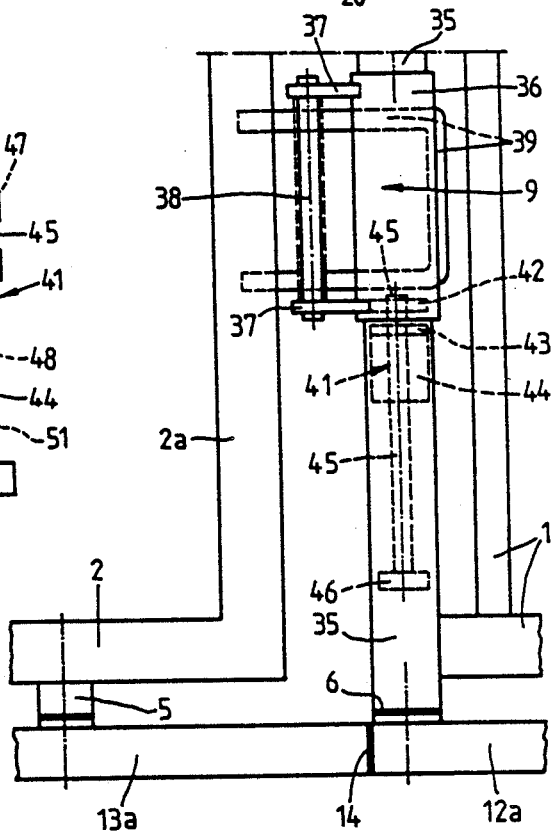
Fig.6

ADJUSTABLE HOSPITAL AND NURSING HOME BED

BACKGROUND OF THE INVENTION

1. Field of the Invention

The invention relates to an adjustable hospital and nursing home bed, having a three-part support frame for mattresses, the head, middle and foot frame portions of which are pivotably connected to one another via pivot shafts and are supported in such a manner as to be adjustable in height in a suspension frame of a bed frame by a force provider, preferably a gas spring, directly or indirectly via a lever linkage.

2. The Prior Art

A hospital and nursing home bed of this kind is disclosed in German Utility Model No. 85 13 264, but its suspension frame forms an intrinsically inseparable structural unit, so the complete bed is relatively bulky to store and ship.

Furthermore, only the height of the support frame parts with respect to the stationary suspension frame can be adjusted, so that this adjustment option often is inadequate.

SUMMARY OF THE INVENTION

The object of the present invention is to embody a hospital and nursing home bed of the above generic type such that it can be knocked down and stored and shipped in a space-saving manner, and so that dismantling and assembling of the bed parts and of the adjusting mechanism can be done quickly and reliably with relatively few manual operations.

According to the invention, this object is attained by providing that the suspension frame is embodied such that it is divided transversely to the longitudinal direction of the bed such that it can be taken apart and is retained removably on head and footboards of the bed frame. The division of the suspension frame is located inside the two long struts in the abutting region between the head part and the middle part of the support frame and their pivot shafts on the suspension frame. The head part of the frame is supported in one U-shaped suspension part, and the middle and foot parts of the support frame are supported in the second U-shaped suspension frame part, such that they are pivotable in height. The suspension frame parts are removable from the head and footboard, respectively. The two long struts of the two support frame parts are plugged into one another in the abutting division region and this plug connection is locked by means of one screw, plug bolts, or the like. Offset plug-in extensions are provided on the long struts of one of the parts of the suspension frame. These extensions fit into the long struts of the second suspension frame part. The suspension frame has laterally secured bearing brackets with protrusions on the head and foot end of its two suspension frame parts, and suspension brackets having suspension slits are secured to the head and footboard. The suspension frame parts are detachably suspended with their protrusions in these suspension slits. The gas spring articulately engages two adjacent frame parts, and the two levers of the lever linkage, which is supported on the two adjacent frame parts and are couplable to one another kinetically, are detachably connected at a connecting point located at one side of the support frame division. The gas spring rests pivotably with one long end in the pivot shaft on a lever secured to the head part of the support frame with its other long end, with a transverse bolt, removably suspended in suspension hooks of one traverse strut of the suspension frame part, and is secured in the suspended position by a U-shaped shackle that can be slipped onto this end.

The transverse bolt, with suspension protrusions on its face ends, engages angular suspension slits of two suspension hooks. The transverse bolt in the suspension position is located between the two suspension hooks and the U-shaped shackle, inserted from above, resting with its transverse strut between the vertical edge and the hook protrusions of the suspension hooks and with its downwardly oriented legs fitting over the face ends of the transverse bolt and extending in front of the suspension protrusions, thereby fixing the suspension protrusions in the slit ends of the suspension slits.

A transverse rod, serving as a pivot shaft, extends through the extension hooks, having one bend hand lever on each of its two long ends, and a push lever is disposed between the suspension hooks. This push lever, when the transverse rod is pivoted, actuates a control pin of the gas spring.

The force provider maybe embodied by an electric motor having a threaded spindle that is displaceable in a telescoping fashion. This threaded spindle pivotably rests with one end in the pivot shaft on the lever of the head part of the support frame and is removably suspended, with a transverse bolt disposed on the electric motor, in suspension hooks of the suspension frame part and is fixed in the suspended position by means of a U-shaped shackle that can be slipped onto it.

A further object is an improved and expanded adjusting option compared with the known beds of this kind, specifically providing a separate adjustment for the head part of the frame, a joint adjustment of the head, middle and foot part of the frame, and an additional adjustment in height of the head, middle and foot parts of the frame.

This object is attained by providing that a shaft, with a bushing slipped over it, is disposed on the head part of the support frame in a coaxial extension to its pivot shaft. Two lever arms having a transverse rod located between them and extending parallel to the shaft, are secured on this bushing in an extension of the head part of the support frame. A shackle is welded to the middle part of the support frame, the shackle extending with a gap below the transverse rod when the head part is in the horizontal position and entering into an articulated pivot connection with the transverse rod. A separable locking device having a spring-loaded locking bar and two catches secure on the bushing and on the shaft and penetrated by the locking rod, is provided on the shaft and bushing.

The headboard and footboard are embodied as telescoping with one another and are continuously adjustably in height one with a suspension frame and the support frame by means of gas springs.

The headboard and footboard are each embodied by a U-shape shackle, with the suspension brackets secured thereon and removably retaining the suspension frame. Two tubes engaging the inside of the legs of the U-shaped shackle from below and joined by a transverse strut are provided wherein a vertical gas spring 10 extends from between the two transverse struts and the horizontal cross bar of the U-shaped shackle.

The gas spring, with its displaceable piston rod, is firmly supported on a bearing secured to the transverse strut. A foot pedal that is pivotable about a horizontal shaft actuates the gas spring being supported in the bearing, and the foot pedal is secured against unintentional actuation by means of a securing ring disposed pivotably on the transverse strut.

The scope of the invention encompasses not only the characteristics of the individual claims but also their combination with one another.

The advantages of the invention are as follows:

1. The complete hospital and nursing home bed is embodied such that it can be knocked down; its suspension frame, with the support frame adjustably retained in the suspension frame, can be taken apart transversely to the longitudinal direction and removed from the headboard and footboard, thus creating bed parts that are compact and thus can be stored and shipped in a space-saving manner.
2. Assembly and dismantling of the bed parts can be done conveniently and quickly with few manual operations, and the connecting points of the bed parts have connecting means that mesh reliably and stably with one another.
3. By the use of a gas spring or a motor-driven telescoping spindle, a separate adjustment of the inclination of the head part of the frame is attainable, and in combination with the lever linkage, an adjustment of the inclination of the head and middle parts of the frame simultaneously, in a separate pivoting motion, is possible.
4. These adjusting devices (telescoping springs or telescoping spindle and lever linkage) are easy to remove at their connecting points when the bed is dismantled.
5. Because the headboard and footboard are continuously adjustable in height in telescoping fashion by means of gas springs, the height of the suspension frame and supporting frame can also be set, independently of the setting for the inclination of the support frame, which makes it possible for the entire bed to be individually set.

Still other objects, features and attendant advantages of the present invention will become apparent to those skilled in the art from a reading of the following detailed description of the embodiments constructed in accordance therewith, taken in conjunction with the accompanyinq drawings.

BRIEF DESCRIPTION OF THE DRAWINGS

The invention of the present application will now be described in more detail with reference to the preferred embodiments of the device, given only by way of example, and with reference to the accompanying drawings, in which:

FIG. 2 is a perspective view of the detachable connection of a gas spring between the suspension frame and the head part of the frame, seen in the direction of the arrow A of FIG. 1;

FIG. 2*a* is a side view, partly in section, of the detachable connection between the gas spring and the suspension frame, shown joined together;

FIG. 3 is a perspective view of an electric motor having a telescoping spindle for pivoting the support frame, in the detachable connection of the electric motor and telescoping spindle to the support frame and to the suspension frame;

FIG. 3*a* is a side view of the detachable connection between the electric motor and the suspension frame in the joined state;

FIG. 4 is an end view, partly in section, of an actuating mechanism for adjusting the height of the headboard and footboard by means of a gas spring;

FIG. 5 is a side view, partly in section, of the gas spring and a lever linkage cooperating with it for adjusting the supports frame, seen in the direction of the arrow B of FIG. 1;

FIG. 6 is a plan view on the lever linkage disposed between the head part and the middle part of the support frame; and FIG. 7 is a plan view on a locking device for the lever linkage of FIGS. 5 and 6.

DESCRIPTION OF THE PREFERRED EMBODIMENT

Figure 1:
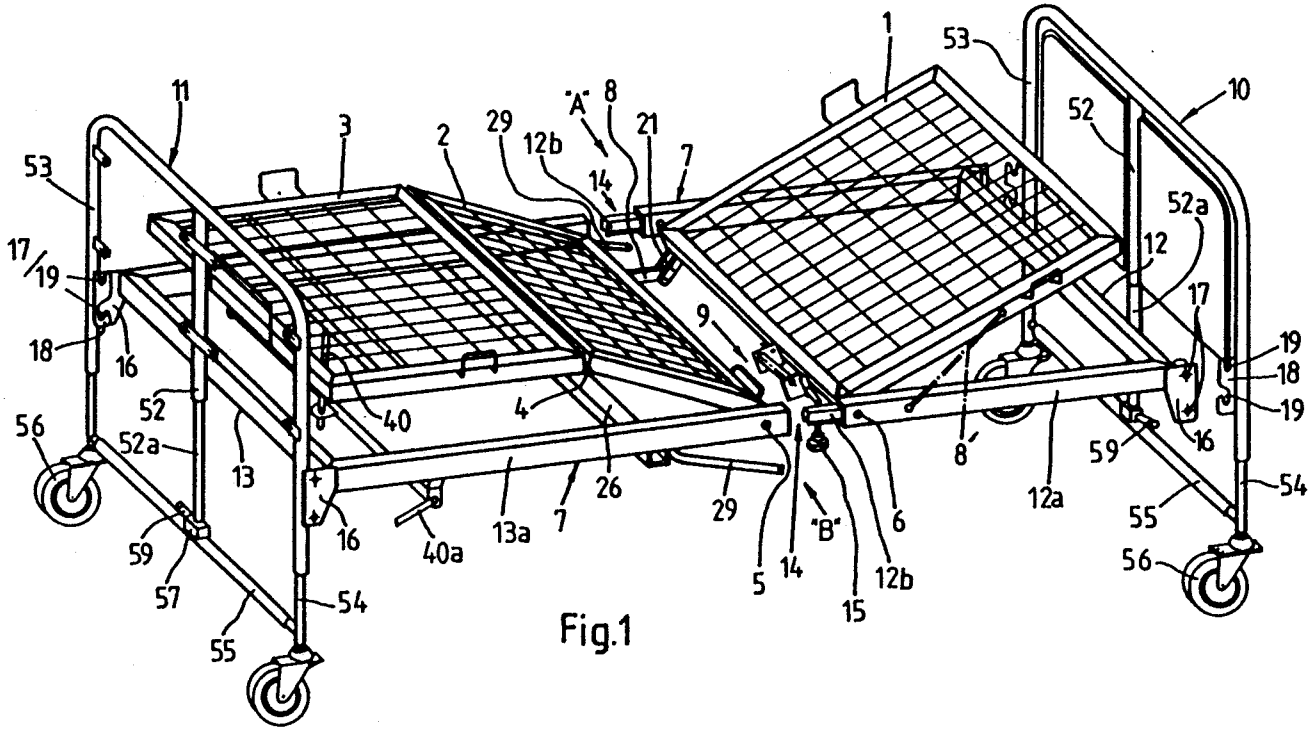
FIG. 1 is a perspective view of an adjustable hospital and nursing home bed having a three-part support frame for mattresses, which is supported such that it is adjustable in height in a suspension frame that can be dismantled, with the support frame shown separated and also, on the right, removed from the headboard.

The adjustable hospital and nursing home bed has a three-part support frame for mattresses, which comprises a head, middle and foot part 1, 2, 3; these three frame parts 1, 2, 3 are pivotably connected within a suspension frame 7 and to one another and via pivot shafts 4, 5, 6 and are supported in this suspension frame 7 such that they are directly adjustable in height by a force provider, preferably a gas spring 8, and indirectly via a lever linkage 9.

The suspension frame 7, together with a headboard and footboard 10, 11, respectively, forms a bed frame. The support frame 7 is divided transverse to the longitudinal direction of the bed and is embodied such that it can be taken apart and is removably retained on the headboard and footboards 10, 11.

The dividing line of the support frame 7 is located in its two long struts 12*a*, 13*a* in the abutting region 14 between the head part 1 and middle part 2 of the support frame and their pivot shafts 5, 6 on the suspension frame 7; as a result, the support frame 7 is divided into two support frame parts 12, 13, each having a basically U-shaped form, which two frame parts 12, 13 are removably connected to one another. The two long struts 12*a*, 13*a*, which extend on both sides of the suspension frame 7 and thus parallel to the suspension frame parts 12, 13, are inserted into one another at the dividing point 14, and this plug-in connection is locked in place by a screw 15, a plug bolt or the like.

The long struts 12*a*, 13*a* are embodied by profiled tubes having a polygonal cross section, for instance a square or rectangular cross section, and the two long struts 12*a* have offset insertion extensions 12*b*, with which they fit into the long struts 13*a*.

The screw 15 in each case meshes with the inside of this plug connection 12*b*, 13*a*.

The suspension frame 7, at the head and foot end of its two suspension frame parts 12, 13, has laterally secured support brackets 16 with protrusions 17, and suspension brackets 18 with suspension slits 19 are secured to the headboard 10 and footboard The suspension frame 7 is detachably suspended with the protrusions 17 in the suspension slits 19 of the headboard 10 and footboard 11.

Each support bracket 16 has two protrusions 17, one above the other, and each suspension bracket 18 has an upper vertical suspension slit 19 and a lower suspension slit 19 extending at an angle.

The head part 1 of the support frame is supported such that it is adjustable in height in one part 12 of the suspension frame, while the middle and foot parts 2, 3 of the support frame are supported, adjustably in height, in the second suspension frame part 13. Thus, the suspension frame part 12 and head part 1 of the support frame are detachable from the suspension frame part 13, and the other two support frame parts 2, 3, and both suspension frame parts 12, 13, with their support frame parts 1 or 2, 3, respectively, are removable from the associated headboard 1o or footboard 11.

The gas spring 8 serves to adjust the height of the head part 1 of the support frame and, in combination with the lever linkage 9, to pivot the height of the middle and foot parts 2, 3 of the support frame. The gas spring 8 is pivotably supported at two adjacent parts of the frame, that is, on the head part 1 of the support frame and also on the suspension frame part 12, and is detachable from the head part 1 on which it is pivotably supported.

As FIGS. 2 and 5 show, the support spring 8, with one long end, rests in the pivot shaft 20 in levers 21 secured to the head part 1 of the support frame. The displaceable piston rod 8*a* of the gas spring 8, at its free end, has a cross bolt 22, with suspension protrusions 23 protruding from both face ends, and this cross bolt 22, with its suspension protrusion 23, engages angular suspension slits 24 of two suspension hooks 25, which are secured on a cross strut 26 of the suspension frame part 13.

In the suspended position, the cross bolt 22 is located between the two suspension hooks 25, and the suspension hooks 23 extend within the suspension slits 24.

Securing of this suspension connection is effected by a U-shaped shackle 27, which from above fits over both face ends of the cross bolt 22, and with its cross beam 27*a* rests between the vertical edge 25*a* and the hook protrusions 25*b* of the suspension hooks 25, and with its legs 27*b* oriented downward is placed in front of the suspension protrusions 23 and fixes it in the end 24*a* of the suspension slits 24 (see FIGS. 2 and 3*a*, as well as FIG. 5).

For locking the detachable suspension connection, the U-shaped shackle 27 is simply fitted on from above and then is selfholding.

To disconnect the suspension connection, U-shaped shackle 27 is removed upwardly, so that the cross bolt 22 and its suspension protrusion 23 can be removed from the suspension hook 25.

A transverse rod 28 extends through the suspension hook 25 and serves as a pivot shaft, which is equipped on both long ends with a bent hand lever 29. A push lever 30 is attached to the transverse rod 28, for actuating a control pin 31 of the gas spring 8 upon pivoting of the transverse rod.

The person in the bed pivots the hand lever 29, thus pressing the push lever 30 against the control pin 31, which actuates the gas spring 8, which then extends or retracts again in order to pivot the head part I of the support frame.

A stop 32 secured to the suspension hook 25 is provided for the push lever 30 in the outset position.

In the variant embodiment of FIGS. 3 and 3*a*, the force provider is embodied by an electric motor 33 having a threaded spindle 34 that is displaceable in telescoping fashion; the threaded spindle 34, in turn, is pivotably supported with one end in the pivot shaft 20 on the lever 21 of the head part 1 of the support frame, and with a cross bolt 22 protruding from the electric motor is detachably suspendable in the suspension hook 25 and fixable by means of the U-shaped shackle 27.

This detachable suspension connection is equivalent to the embodiment of FIGS. 2 and 2*a*.

The threaded spindle 34 is embodied in two parts. One spindle part 34*a* is rotated by the motor 33, causing the other spindle part 34*b* to execute a displacement motion in the longitudinal direction.

The cross bolt 22 is secured to the motor 33 via spacers 2*a*.

As can be seen from FIGS. 1 and 5–7, the head part 1 of the support frame has a shaft 35 in a coaxial extension of its pivot shaft 6; a bushing 36 is slipped over this shaft 35. Two lever arms 37 are welded to the bushing 36 in an extension of the head part 1, and between them a transverse rod 38, preferably surrounded by a roller (not shown), is inserted parallel to the shaft 35.

A shackle 39 is welded to the middle part 2 of the support frame, which protrudes past the pivot shaft 5 toward the head part 1 with a segment 2*a* functioning as a lever arm; the shackle 39 extends below the transverse rod 38 by a gap S, when the head part 1 is located horizontally.

The transverse rod 38 with its roller and its lever arms 37, together with the U shaped shackle 39, form the lever linkage 9 and produce a partly articulated connection, on the condition that the bushing 36 is connected to the shaft 35.

In the position shown in FIG. 5, the articulated connection is separated about the gap S, because the middle support frame part 2 is held in a horizontal position. If the head support frame part 1 is pivoted about the angle W, for instance 10 to 15° then the articulated connection comes into engagement in that the transverse rod 38 presses on the U-shaped shackle 39, and upon further pivoting, the middle part 2 of the support frame is jointly pivoted about its shaft 5.

The shape and inclination of the legs of the shackle 39 with respect to the radius of the path of motion of the transverse rod 38 defines the ratio of the inclinations of the two frame parts 1, 2 to one another.

In the embodiment shown, once engagement of the articulated connection 38, 39 begins, the middle frame part 2 is positioned with a relatively pronounced increase in pivot angle, which decreases once again as pivoting continues.

With the pivoting of the middle frame part 2, a pivoting of the foot frame part 3 is performed simultaneously.

The foot frame part 3 can also be guide by a known height guide means 40 and/or by a gas spring 40 having a hand lever 40*a* when the middle frame part is pivoted, or can be adjusted in height in a separate operation (see FIG. 1).

For pivoting the head and middle frame parts 1, 2, the shaft 35 and the bushing 36 are coupled to one another by a locking device 41.

This locking device 41 has two cooperating catches 42, 43. Catch 43, is secured to the shaft 35 and catch 42 is secured to the bushing 36. These two catches 42, 43 extend downward in an angle, preferably a right angle, to the lever arms 37. A sheath 44, in which a locking bar 45 is displaceably supported, is secured to the catch 43.

The locking bar 45 protrudes at both ends from the sheath 44 and at one end has an operating button 46, while its other end, in the locking position, engages a bore 47 of the catch 42 secured to the bushing 36.

A prestressed compression spring 48, which retains the locking bar 45 in the bore 47, is located in the sheath 44. The locking bar 45 is secured against torsion in the locking position by a cross pin 49, which cooperates with an axial slit 50 in the sheath 44.

By pulling on the knob 46 counter to the spring force, the locking bar 45 can be removed from the bore 47 into the unlocking position, whereupon the cross pin 49, by rotation of the knob 46, can be moved into a flat groove 51 on the face end of the sheath 45, and the locking bar 45 can thus be retained in the unlocking position.

The kinetic connection of the shaft 35 and bushing 3 is thus broken, and the head part 1 of the support frame can be pivoted by the gas spring 8, while the middle part 2 remains in 15 its horizontal position.

As can be seen from FIG. 1, the headboard 10 and footboard 11 are each continuously adjustable in height by mean of one gas spring 52 for each of them, and when this adjustment in height is made, the suspension frame 7 along with the support frame 1, 2, 3 is likewise adjusted in height.

The headboard and footboard 10, 11 are each embodied by one U-shaped shackle 53, with the support brackets 18 secured to it and holding the suspension frame 7 in a removable manner, and by two tubes 54 engaging the inside of the legs of the U-shaped shackle 53 from below; these two tubes 54 are joined by a transverse strut 55, on which rotatable and steerable wheels 56 are disposed.

The vertical gas spring 52 extends between the transverse strut 55 and the horizontal cross bar of the U-shaped shackle 53; the displaceable piston rod 52 of the gas spring is firmly placed on a bearing 57 secured to the transverse strut 55. This bearing 57 receives a foot pedal 59 that is pivotable about a horizontal shaft 58 and in its pivoting actuates the control pin **52*b* of the gas spring 52** in order to extend and retract it.

A securing ring 60 pivotably supported on the transverse strut 55 can be pivoted under the foot pedal 59, as FIG. 4 shows, and secures the foot pedal from unintentional actuation. For actuating the foot pedal, the securing ring 60 is pivoted out of the way underneath the foot pedal 59 in the direction of the arrow.

As schematically shown in FIG. 1, it is also possible to dispose the gas spring 8 articulately between the head part 1 of the support frame and the suspension frame part 12; in that case, not only can the head part 1 be adjusted separately with respect to the suspension frame 7 by means of this gas spring 8, but also a joint pivoting of the middle part 2 of the support frame simultaneously with the locking of the lever linkage 9 by the cooperating pivot levers 3, 38/39 is possible.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and ar intended to be comprehended within the meaning and range of equivalents of the disclosed embodiments. It is to be understood that the phraseology or terminology employed herein is for the purpose of description and not of limitation.

What is claimed is:

1. An adjustable hospital and nursing home bed having a bed frame, said bed comprising:

a three-part support frame for mattresses comprising head, middle and foot parts;

a suspension frame of the bed frame for supporting said head, middle and foot parts, said suspension frame comprising two portions divided transversely to the longitudinal direction of the bed, said two portions being adapted to be taken apart and being removably retained on a headboard and a footboard, respectively, of the bed frame;

pivot shafts for pivotably supporting said head, middle and foot parts on said suspension frame and for pivotably connecting said head and middle parts and said middle and foot parts to one another.

force provider means for providing direct height adjustment to said head part, said force providing means comprising a gas spring; and a lever linkage for indirectly providing height adjustment to said middle and foot parts;

wherein said gas spring articulately engages one of said support frame parts and an adjacent suspension frame part, said lever linkage comprises two levers which are supported on two adjacent support frame parts, are couplable to one another kinetically, and are detachably connected at a connecting point located on one side of the support frame division;

wherein said gas spring rests pivotably with one long end on a pivot shaft on a lever secured to the head part of the support frame, and another long end having a transverse bolt, is removably suspended in suspension hooks of one transverse strut of one of the suspension frame parts, and is secured in the suspended position by a U-shaped shackle that can be slipped onto the another end; and wherein the transverse bolt has suspension protrusions on its face ends which are adapted to engage angular suspension slits of two suspension hooks, the transverse bolt in the suspension position being located between the two suspension hooks and the U-shaped shackle, inserted from above, having a transverse strut resting between a vertical edge and the hook protrusions of the suspension hooks and downwardly oriented legs fitting over the face ends of the transverse bolt and extending in front of the suspension protrusions, thereby fixing the suspension protrusions in slit ends of the suspension slits.

2. An adjustable hospital and nursing home bed having a bed frame, said bed comprising:

a three-part support frame for mattresses comprising head, middle and foot parts;

a suspension frame of the bed frame for supporting said head, middle and foot parts, said suspension frame comprising two portions divided transversely to the longitudinal direction of the bed, said two portions being adapted to be taken apart and being removably retained on a headboard and a footboard, respectively, of the bed frame;

pivot shafts for pivotably supporting said head, middle and foot parts on said suspension frame and for pivotably connecting said head and middle parts and said middle and foot parts to one another;

force provider means for providing direct height adjustment to said head part, said force providing means comprising a gas spring; and a lever linkage for indirectly providing height adjustment to said middle and foot parts;

wherein said gas spring articulately engages one of said support frame parts and an adjacent suspension frame part, said lever linkage comprises two levers which are supported on two adjacent support frame parts, are couplable to one another kinetically, and are detachably connected at a connecting point located on one side of the support frame division;

wherein said gas spring rests pivotably with one long end on a pivot shaft on a lever secured to the head part of the support frame, and another long end having a transverse bolt, is removably suspended in suspension hooks of one transverse strut of one of the suspension frame parts, and is secured in the suspended position by a U-shaped shackle that can be slipped onto the another end; and further comprising a transverse rod, serving as a pivot shaft, a push lever disposed between the suspension hooks which, when the transverse rod is pivoted, actuates a control pin of the gas spring.

3. An adjustable hospital and nursing home bed having a bed frame, said bed comprising:

a three-part support frame for mattresses comprising head, middle and foot parts;

a suspension frame of the bed frame for supporting said head, middle and foot parts, said suspension frame comprising two portions divided transversely to the longitudinal direction of the bed, said two portions being adapted to be taken apart and being removably retained on a headboard and a footboard, respectively, of the bed frame;

pivot shafts for pivotably supporting said head, middle and foot parts on said suspension frame and for pivotably connecting said head and middle parts and said middle and foot parts to one another;

force provider means for providing direct height adjustment to said head part;

a lever linkage for indirectly providing height adjustment to said middle and foot parts;

wherein the headboard and footboard telescope with one another and are continuously adjustable in height along with the suspension frame and the support frame by means of gas springs;

wherein the headboard and footboard are each embodied by a U-shackle, with the suspension brackets secured thereon and removably retaining the suspension frame, and two tubes engage the inside of the legs of the U-shackle from below and joined by a transverse strut, wherein a vertical gas spring extends between the two transverse struts and a horizontal cross bar of the U-shackle; and wherein the gas spring, having a displaceable piston rod, is firmly supported on a bearing secured to the transverse strut, a foot pedal that is pivotable about a horizontal shaft and actuates the gas spring is supported in the bearing, and the foot pedal is secured against unintentional actuation by means of a securing ring disposed pivotably on the transverse strut.

* * * * *